United States Patent [19]

Pardini

[11] Patent Number: 4,507,527

[45] Date of Patent: Mar. 26, 1985

[54] CURRENT LIMITING CIRCUIT-BREAKER HAVING AN IMPROVED CONTACT ARRANGEMENT

[75] Inventor: Franco P. Pardini, Milan, Italy

[73] Assignee: General Electric Company, New York, N.Y.

[21] Appl. No.: 485,925

[22] Filed: Apr. 18, 1983

[30] Foreign Application Priority Data

May 21, 1982 [IT] Italy ..... 21411 A/82

[51] Int. Cl.[3] ..... H01H 33/14; H01H 9/40

[52] U.S. Cl. ..... 200/145; 200/147 R; 335/16; 335/195

[58] Field of Search ..... 200/145, 147 R; 335/195, 16

[56] References Cited

U.S. PATENT DOCUMENTS 3,953,811 4/1976 Mostosi ..... 335/16

FOREIGN PATENT DOCUMENTS 3447 8/1979 European Pat. Off. ..... 335/195

*Primary Examiner*—Robert S. Macon

*Attorney, Agent, or Firm*—Richard A. Menelly; Walter C. Bernkopf; Fred Jacob

[57] ABSTRACT

A current limiting circuit breaker contains a pair of electrical contacts within separate chambers arranged side-by-side and isolated by means of an insulated barrier. The contacts are electrically connected in series such that the arcs formed between the contact pairs are magnetically motivated by the sum of the current paths through both contact pairs.

7 Claims, 4 Drawing Figures

CURRENT LIMITING CIRCUIT-BREAKER HAVING AN IMPROVED CONTACT ARRANGEMENT

BACKGROUND OF THE INVENTION

The invention relates to a contact arrangement for low voltage insulated case circuit breakers which utilize current limitation to increase their interruption speed while at the same time reducing thermal and electromechanical stresses on both the circuit breaker components and the protected circuits.

One example of a current limiting breaker having a single pair of operating contacts per pole is described within U.S. Pat. No. 4,375,021 to Pardini et al, which patent is incorporated herein for reference purposes.

SUMMARY OF THE INVENTION

Each pole of a current limiting circuit breaker is associated with two substantially equal breaking chambers which are separated by means of an insulating wall such that each half-pole contains a separate pair of contacts which are electrically connected in series. Each contact pair includes a movable contact arm under the control of the circuit breaker operating mechanism which serves to make or break the current, and a fixed or less movable contact arm which cooperates with the movable contact arm. Both the fixed and movable contact arms may be free to move under short circuit conditions by means of electrodynamic repulsion.

In one embodiment of the invention, the movable contact arms of both of the two contact pairs are serially connected by means of a flexible wire attached to their ends opposite the contacts so that the fixed contact arms abut the movable arms along their entire length whereby a short circuit current through the contacts results in a strong electrodynamic repelling force on the movable contact arms.

Both of the two separable contact pairs faces an arc chamber which usually contains deionizing plates.

In a further embodiment of the invention the contact arms and deionizing plates are placed at right angles to the vertical support in a manner similar to the earlier embodiment with only one movable contact arm controlled by the contact operating mechanism.

The other contact pair solely contributes to current interruption under short circuit conditions by electrodynamic repulsion. In this manner, the circuit breaking efficiency under short circuit conditions is not decreased while the mechanical construction of the contact assembly is simplified.

When the line terminals of each pole are located in one chamber and the load terminals of each pole are located in the other chamber, the possibility of a short circuit between both terminals due to the exit of ionized gas coming out of both chambers is practically nonexistent.

GENERAL DESCRIPTION OF THE INVENTION

Figure 1:
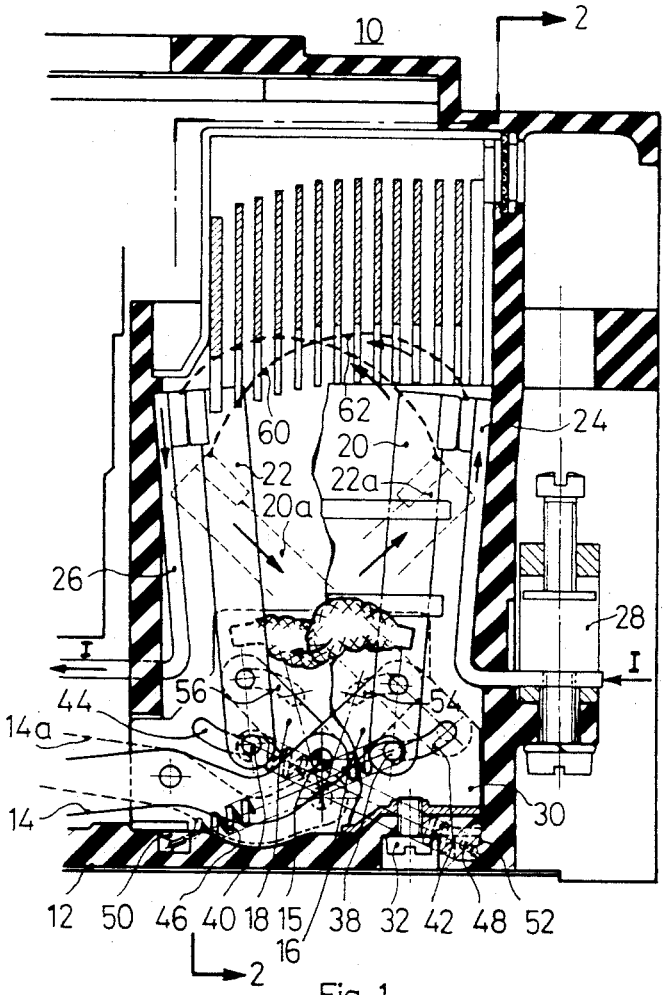
FIG. 1 is a cut-away view of one pole of the current limiting circuit breaker of the invention which includes a pair of movable contact members having reciprocally opposite directions.

The invention comprises a current limiting circuit breaker wherein two operating contact pairs electrically connected in series are opened under short circuit operating conditions by electrodynamic repulsion. The contacts are arranged side-by-side and interconnected such that the electrodynamic force on each of the two arcs and on the corresponding separated contact arms is provided not only by current flowing to said contact arms, but also by the current flowing through the contact arms arranged side by side.

The series arrangement of the contacts increases the arc suppression rate as well as the arc generation speed such that the total interrupting time is substantially reduced. The arc power developed within the circuit breaker and the short circuit current let through is subsequently reduced as a result.

The reduction of the arc power allows a successful current breaking operation to be performed within a very reduced space and so that the two pairs of operating contacts fit within the space occupied by a single contact pair of prior art configuration.

The utility of the invention is best appreciated by considering that the width of each pole of the circuit breaker which includes the contacts and the arc chamber is generally determined not by current interruption requirements, but by the current that the pole must carry during normal service as well as by the size of the supply cable connected to the pole terminals. The present invention provides a circuit breaker with high current interruption capacity without requiring increased dimensions in proportion to the current as would be required with prior art designs.

One embodiment of the invention provides the control of both of the separable contact pairs through the operating mechanisms utilized to drive a single pair of separable contacts. It provides, therefore, a contact force for each of the four separable contacts forming the two pairs substantially the same as that available on each one of the separable contacts of a single pair by utilizing the same operating mechanism.

One of the movable contact arms, which corresponds to the line terminal, moves downward while the other, which corresponds to the load terminal, moves upward. As the movable contact arms, in an opened position, carry opposing currents, an intense electrodynamic force is generated which tends to keep the arms separated, thereby avoiding temporary repetitive closing of the contacts which could otherwise occur upon opening under short circuit conditions. When the contacts are separated, an electrodynamic force in the same direction is created between the movable contact and the fixed contact of the adjacent contact pairs. The reciprocal arrangement of the movable and fixed contact members substantially increases the electrodynamic motivating force on the arc compared to two contact pairs electrically connected in series and arranged according to the teachings of the prior art. This occurs because the electrodynamic force on arc is provided not only on the current through the contacts to which the arc is associated, but also on the current through the contacts associated with the adjacent arc.

The movable contact arms are operated through wedge-shaped levers, so that it is possible to obtain an adequate contact force on each pair of cooperating contacts, utilizing operating mechanims developing forces or torques no more powerful than the ones used for a single pair of contacts of prior art with same rated continuous current.

One embodiment of the invention provides that one end of the movable contact arm of one of the contact pairs is connected by means of a flexible wire to the end of the arm opposite the contacts of the fixed contact arm so that both of the two contact pairs will be connected in series. The current conductors of both contact pairs cooperate such that the current conductor to one pair of contacts will effect both of the contact arms and the arc between the same pair of contacts, as well as on the contacts arms of the other adjacent pair of contacts. In this embodiment, the line and load terminals are connected to the fixed contact of the contact pair, and to the movable contact arm of the adjacent contact pair.

DESCRIPTION OF THE PREFERRED EMBODIMENTS

Figure 2:
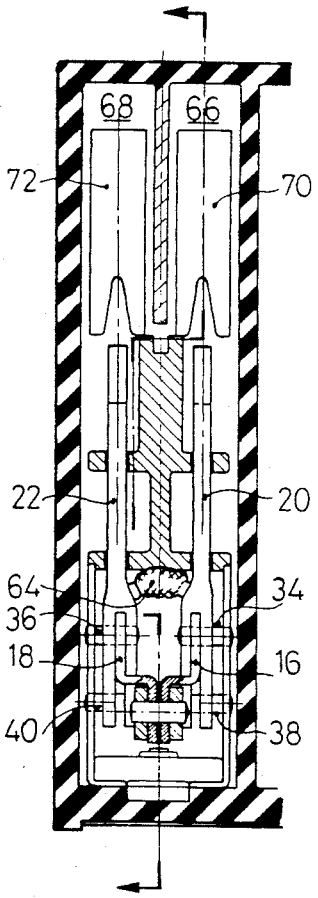
FIG. 2 is a cross-section view along the plane 2—2 of FIG. 1 depicting the movable contact member pair.

FIGS. 1 and 2 show a circuit breaker 10 according to the invention contained within a plastic case 12, including an operating mechanism which, by means of a first lever 14 and two wedge-shaped levers 16 and 18, operates on a pair of movable contact arms 20 and 22, each associated with fixed contact members 24 and 26, wherein movable contact arm 20 and fixed contact arm 24 lie in a first plane, while movable contact arm 22 and fixed contact arm 26 lie in a second plane which is parallel and offset with respect to the first plane.

Fixed contact arm 24 is connected with a line terminal 28 that provides for connection of the corresponding pole with an external line. Fixed contact arm 26 is connected with other parts of the circuit breaker, such as the trip unit or similar elements (not shown) and from there to an external load.

The assembly of both the movable contact arms 20 and 22 is supported by a small rigid frame 30, which is attached to case 12 by suitable fastening means such as one or more screws 32. Movable contact arms 20 and 22 are fitted with intermediate pins 34, 36 and with end pins 38, 40 at the ends opposite to the contacts. Pins 34 and 36 allow for rotation of the respective arms 20 and 22, while pins 38 and 40 are moved along slots 42, 44 within small frame 30 to allow for the movement of arms 20 and 22 under short circuit repulsion forces caused by short circuit current through movable and fixed arms 20, 22 and 24, 26. The short circuit forces overcome the bias from contact springs 46, 48 which are located respectively between pin 38 and bracket 50 and between pin 40 and bracket 52 and moves arms 20, 22 to the positions shown respectively at **20*a* and 22*a***.

When circuit breaker 10 is opened either by external means or as a result of tripping, lever 14 moves into position **14*a*, pulling pin 15 downwards such that the two wedge-shaped levers 16, 18 also move downwards and pull the intermediate pins 34 and 36 closer together within their respective slots 54 and 56. Movable contact arms 20 and 22 become rotated around respective end pins 38 and 40 to the positions designated at 20*a* and 22*a*** as a result of the repulsion due to the short circuit currents.

When the contacts are opened, either due to repulsion forces associated with short circuit currents or by external means, arcs 60 and 62 are motivated under the electrodynamic forces due to current I that runs from the fixed contact 24 to movable contact 20, then from movable contact 20 to movable contact 22 through one or more flexible conductors 64 to fixed contact 20. The arcs are blown into their respective extinction chambers 66 and 68 wherein they become extinguished by means of deionizing plates 70 and 72.

It has to be noticed that the current paths which run from fixed contact 24, through arc 60 to movable contact 20 and from movable contact 22 throughout arc 62 to fixed contact 26 are all in a direction such that the electrodynamic forces on two arcs 60 and 62 is contributed by all the above current paths. The electrodynamic force is nearly twice that on one arc of a circuit breaker pole containing two pairs of serial connected contacts arranged in accordance with the prior art. When the movable contact arms are at positions **20*a* and 22*a*, they carry currents in opposite directions which results in the development of an intense electromagnetic repulsive force between the arms which tends to keep them opened, thus reducing the possibility of contact bounce which could occur at high contact opening speeds under short circuit conditions. An electrodynamic attractive force in the same direction is developed upon opening conditions between movable contact 20 or 22 and fixed contact 26 or 24** of the adjacent contact pair.

Figure 3:
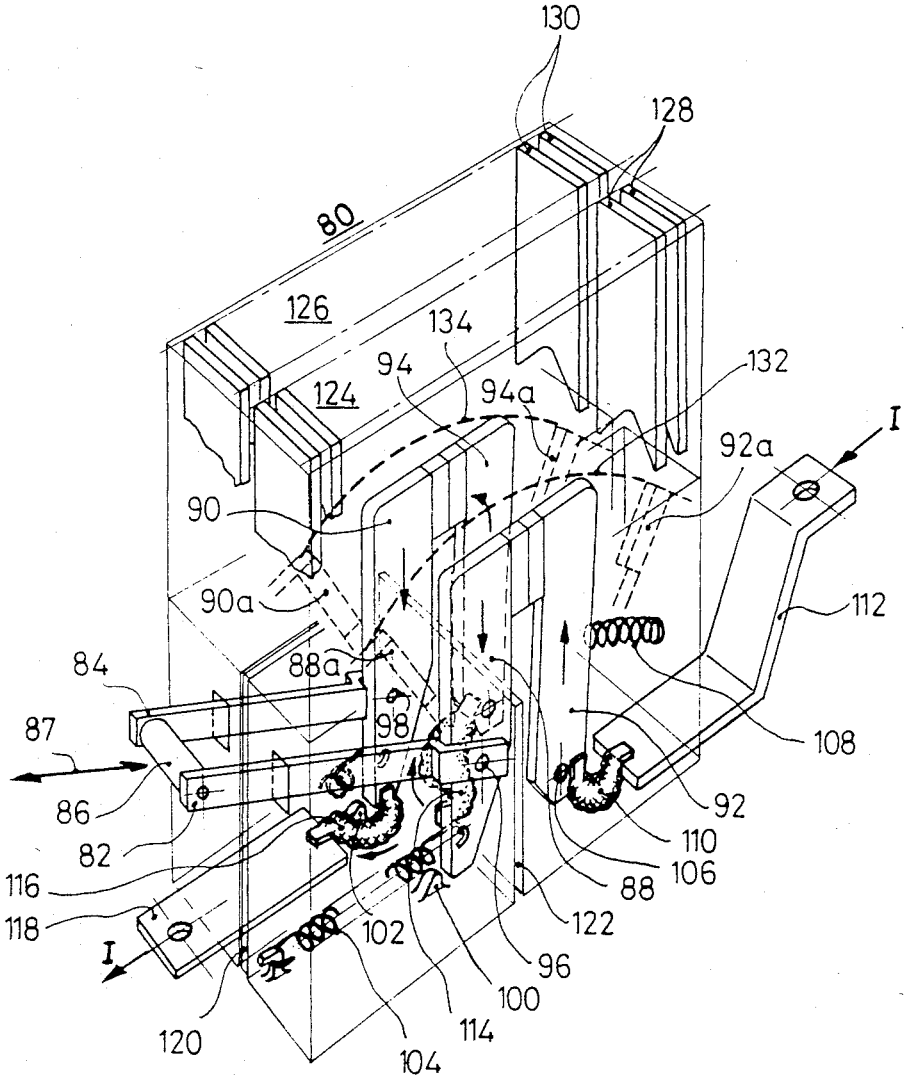
FIG. 3 is a partial perspective view of one pole of the current limiting circuit breaker of the invention which includes a pair of contact members arranged in the same direction.

Reference is made now to FIG. 3 wherein a pole 80 is shown within a current limiting circuit breaker utilizing a further embodiment of the invention. Within pole 80, an operating mechanism which includes two travelling arms 82 and 84 mechanically joined by an insulating member 86 permits motion in the direction of arrow 87 and operates on two movable contact arms 88 and 90, each associated with two fixed contact arms 92 and 94. The two travelling arms 82 and 84 are pivotally connected with the two movable contact arms 88 and 90 by means of two pins 96 and 98, which transfer the motion of arms 82 and 84 to the movable contact arms 88 and 90 which become opened and closed by rotating around fixed supports 100 and 102. Two extension springs, only one of which, 104, is shown, furnish the necessary contact force between the movable and fixed contacts when the circuit breaker is in a closed position. As described earlier, the fixed contact arms 92 and 94 are capable of limited rotation under the short circuit repulsion forces about pin 106, located near the ends opposite the contacts, and are kept in position by means of compression spring 108. The fixed contact arm 92 is electrically connected by means of a flexible braid 110 to a rigid strap 112 for connecting the pole with the line. The movable contact arm 88 is electrically connected with the fixed contact arm 94 by means of a flexible braid 114 and the movable contact arm 90, associated with the fixed contact arms, is connected by means of a flexible braid 116 with a rigid strap 118 on the load terminal end.

Two pairs of contact arms 88, 92 and 90, 94 are insulated from each other by means of insulating wall 120, so that the arcs 132 and 134, which arise between the contacts, evolve towards extinctions chambers 124, 126 which contain deionizing plates 128, 130.

When a short circuit occurs, the contact arms 88, 92 are blown apart by repulsion forces and are rotated around pins 96 and 106 to open and reach respective positions **88*a*, 92*a* overcoming the bias springs 104 and 108. At the same time the two contact arms 90, 94** are blown apart in a like manner.

Upon separation of the contacts, arcs 132 and 134 occur, which are blown towards their respective extinction chambers.

The current I through circuit breaker pole 80 runs from the fixed strap 112 through the flexible braid 110 through the fixed contact arm 92 through movable contact arm 88 through flexible braid 114 to fixed contact arm 94 through movable contact arm 90 through the flexible braid 116 to rigid strap 118. It can be seen that the current travels over two turns in the same direction. Thus electrodynamic forces occur which beneficially influence both arcs 132, 134 and their respective contact arms. Electrodynamic forces resulting from the current that flows through the turn to which the arc is associated and those from the current in the adjacent turn combine such that the forces are nearly twice those applied to one arc and on the associated contact arms. The benefits of this arrangement are decrease in arc duration, limitation of short circuit current let through and an increase in the interrupting capacity of the circuit breaker.

Figure 4:
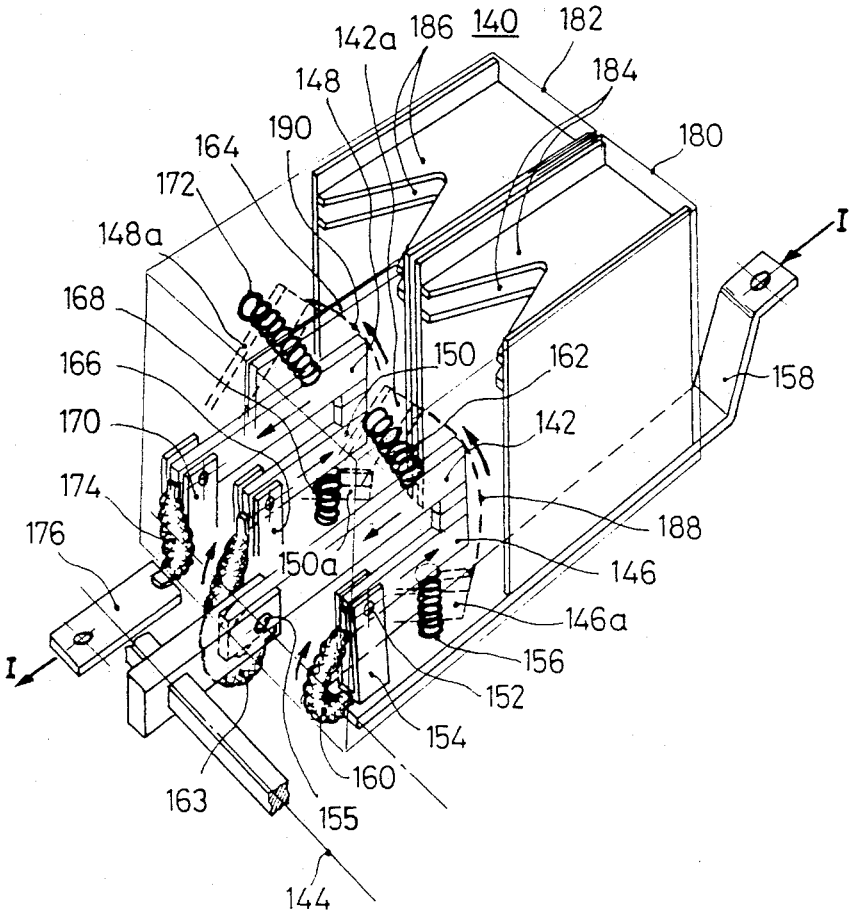
FIG. 4 is a partial perspective view of one pole of the current limiting circuit breaker of the invention which includes a single movable contact arm controlled by the circuit breaker driving mechanism.

Reference is now made to FIG. 4 wherein there is illustrated a pole 140 for a current limiting circuit breaker utilizing a further embodiment of the invention. Two contact pairs respectively located in two separate chambers and are electrically connected in series with only one of the pairs equipped with a movable contact arm 142 which is entrained by the circuit breaking operating mechanism, herein diagrammatically represented as a rotation axis 144, so that during circuit breaker opening and closing operation, the current making or breaking is accomplished by means of a first contact pair consisting of a movable contact arm 142 and a corresponding fixed contact arm 146. In case of short circuits, the value of current I that flows through circuit breaker pole 140 is such as to result in the opening of both a first contact pair consisting of movable contact arm 142 and fixed contact arm 146 and a second contact pair consisting of contact arms 148, 150 electrically connected in series with the first pair. The fixed contact arm 146 is hinged at the point 152 for limited rotation during the repulsion action and is supported by a fixed bracket 154. The arm is kept in closed position by means of a compression spring 156 aburring on one side against contact arm 146, and on the other side against the bottom of the casing passing through a bore in the rigid strap 158 that connects the circuit breaker pole 140 with the line.

A flexible braid 160 insures electrical continuity between strap 158 and fixed contact arm 146. The movable contact arm 142 is kept in a closed position by means of a compression spring 162 and is allowed to rotate about pin 155 which is part of the circuit breaker operating mechanism.

A flexible braid 163 connects movable contact arm 142 with fixed contact arm 150 within the adjacent chamber by passing under an insulating wall 164 that separates the two chambers containing the two respective contact pairs.

The fixed contact arm 150 is hinged on a fixed bracket 166 and is kept in a closed position by means of a compression spring 168. The other fixed contact arm 148 is hinged on a fixed bracket 170 and is kept in a closed position by means of a compression spring 172 and is connected by means of flexible braid 174 with a rigid strap 176 for connection with the load terminal. The two contact pairs 142, 146 and 148, 150 are respectively placed in front of two extinction chambers 180, 182 which contain deionizing plates 184 and 186.

When a short circuit appears, the two contact pairs 142, 146 and 148, 150 are opened by the action of the repulsion forces produced by the current I which overcomes the bias of respective springs 156, 162, 168 and 172 and thus reach their respective opened locations at **142*a*, 146*a*, 148*a* and 150*a*. When the two pair of contacts become separated, arcs 188, 190 occur which contain arc currents in the same direction. In this manner, the electrodynamic forces on each arc are due to associated contacts plus the current paths through the adjacent arc with its associated contacts. As a result, both arcs 188, 190 are motivated towards their extinction chambers 180, 182. Likewise the electromagnetic forces acting on each contact arm are due to current in the adjacent contact arms plus the current in each arc. In this embodiment, current interruption due to tripping of the circuit breaker under moderate overcurrents only occurs between movable contact 142 and the fixed contact 146. Upon circuit interruption due to operating mechanism, the current I that flows through the circuit breaker only affects arc 188** within the first chamber. This arc will be easily extinguished by a single contact pair separation since the current that flows through the circuit breaker is of the same order as the breaker rated current, hence is substantially lower than short circuit currents which are interrupted by contact separation of the serially connected contact pairs caused by electrodynamic repulsion.

Having described my invention, what I claim as new and desire to secure by Letters Patent is:

1. An improved current limiting circuit breaker of the type consisting of one or more poles, each pole comprising two pairs of contacts, electrically connected in series, and each contact pair being within a separate chamber, the improvement comprising:

two circuit breaker chambers arranged side by side within a circuit breaker casing, each of said chambers containing a separate pair of contacts electrically connected in series, whereby upon separation of said contact pairs, a corresponding pair of arcs are created, said arcs being motivated by electrodynamic forces caused by current flow in the same direction through said two contact pairs;

each of said contact pairs consisting of a movable contact arm and a fixed contact arm, said fixed contact arms within each pair being connected with line and load breaker terminals and said movable contact arms within each pair being electrically connected together and being pivotally rotatable in opposite directions; and each of said movable contact arms including an end pin at an end opposite from the contact and a pin intermediate said end pin and said contact, said movable contact arms being pivotally supported by said end pin within an end slot and being pivotally supported by said intermediate pins within an intermediate slot whereby said movable contact arms rotate about said intermediate pins and said end pin slides within said end slot upon short circuit overcurrent and whereby said movable contact arms then rotate about said end pins add said intermediate pin then slides within said intermediate slot.

2. The improved current limiting breaker of claim 1 wherein said movable contact arms are pivotally interconnected by a pair of levers and wherein said end pin is biased within said end slot by means of a spring.

3. The improved current limiting breaker of claim 1 wherein said fixed contact arms within said first pair of contacts is connected with a line terminal, said fixed contact arm within said second pair of contact is connected with said movable contact arm within said first pair of contacts, and said movable contact arm within said second pair of contacts is connected with a load terminal.

4. An improved current limiting circuit breaker of the type consisting of one or more poles, each pole comprising two pair of contacts, electrically connected in series, and each contact pair being within a separate chamber, the improvement comprising:

two circuit breaker chambers arranged side by side within a circuit breaker casing, each of said chambers containing a separate pair of contacts electrically connected in series, whereby upon separation of said contact pairs, a corresponding pair of arcs are created, said arcs being motivated by electrodynamic forces caused by current flow in the same direction through said two contact pairs;

said fixed contact arms within said first pair of contacts are connected with a line terminal, said fixed contact arm within said second pair of contact are connected with said movable contact arm within said first pair of contacts, and said movable contact arm within said second pair of contacts is connected with a load terminal;

said movable contact arms within said first and second pair of contacts are connected together by means of a handle, one arm of said handle being connected to one of said movable contact arms by means of a first pivot pin and another arm of said handle being connected to the other of said movable contact arms by means of a second pivot pin.

5. The improved current limiting breaker of claim 4 further including at least one first spring biasing both said movable contact arms in a closed position and at least one second spring biasing both said fixed contact arms in a closed position, both said fixed contact arms being pivotally connected within said casing at their non-contact ends.

6. The improved current limiting breaker of claim 5 further including a pair of first and second stops on a bottom of said casing for providing pivot points for both said movable contact arms when said handle is moved against said first spring bias.

7. An improved current limiting circuit breaker of the type consisting of one or more poles, each pole comprising two pairs of contacts, electrically connected in series, and each contact pair being within a separate chamber, the improvement comprising:

two circuit breaker chambers arranged side by side within a circuit breaker casing, each of said chambers containing a separate pair of contacts electrically connected in series, whereby upon separation of said contact pairs, a corresponding pair of arcs are created, said arcs being motivated by electrodynamic forces caused by current flow in the same direction through said two contact pairs;

said first pair of contacts within said first chamber comprise a first fixed contact arm connected with a line terminal at one end, and a first movable able contact arm capable of being tripped by an operating mechanism upon overload load conditions and wherein said second pair of contacts with said second chamber comprise two second fixed contact arms, one of said second fixed contact arms being connected with said first movable contact arm, and the other of said second fixed contact arms being connected with a load terminal; and a first spring biasing said first fixed contact arm in a closed position and a second spring biasing said first movable contact in a closed position, a third spring and a fourth spring biasing said two second fixed contact arms in a closed position, whereby said first movable contact arm and said first fixed contact arm overcome the bias of said first and second springs and said two second fixed contacts overcome the bias of said third and fourth springs to open upon short circuit overload and whereby only said first movable contact arm and said first fixed contact arm become opened when tripped by said operating mechanism upon overload conditions.

* * * * *